US005185061A

United States Patent [19]

Lowry et al.

[11] Patent Number: 5,185,061

[45] Date of Patent: Feb. 9, 1993

[54] PROCESSES FOR THE PRODUCTION OF PAPER AND PAPER BOARD

[75] Inventors: Peter Lowry, Suffolk, Va.; David Farrar, Bradford, England

[73] Assignee: Allied Colloids Limited, England

[21] Appl. No.: 711,370

[22] Filed: Jun. 5, 1991

Related U.S. Application Data

[63] Continuation of Ser. No. 460,862, Feb. 1, 1990, abandoned.

[30]

Foreign Application Priority Data

Apr. 22, 1988 [GB] United Kingdom ..... 8809588

[51] Int. Cl.[5] ..... D21H 17/45

[52] U.S. Cl. ..... 162/168.3; 162/183

[58] Field of Search ..... 162/168.2, 168.3, 183; 210/734

[56] References Cited

U.S. PATENT DOCUMENTS 3,901,857 8/1975 Sackman et al. ..... 210/734

3,907,758 9/1975 Sackman et al. ..... 162/168.2

4,913,775 4/1990 Langley et al. ..... 162/168.2

FOREIGN PATENT DOCUMENTS 235893 9/1987 European Pat. Off. .

OTHER PUBLICATIONS

Stratton, *Effect of Agitation on Polymer Additives*, TAPPI Journal, vol. 66 (Mar. 1983) No. 3, pp. 141–144.

*Primary Examiner*—Peter Chin

*Attorney, Agent, or Firm*—Ostrolenk, Faber, Gerb & Soffen

[57] ABSTRACT

The use of very high molecular weight polymers which are substantially completely water soluble as flocculants in paper making improves drainage time without adversely affecting formation, even when used in high shear processes.

12 Claims, No Drawings

PROCESSES FOR THE PRODUCTION OF PAPER AND PAPER BOARD

This is a continuation of application Ser. No. 07/460,862 filed on Feb. 1, 1990 now abandoned.

Paper and paper board is made by draining an aqueous cellulosic suspension through a screen to form a sheet, and drying the sheet. The suspension may be substantially free of filler or may contain substantial amounts of filler.

In any particular process, it is necessary to strike a balance between retention, formation and drainage. Optimum retention occurs when the amount of fibre fines and filler that drains through the screen is minimum. Optimum formation occurs when the paper and paper board is of uniform density and thickness both on a macro scale (e.g., across the width of the sheet) and on a micro scale (e.g., at any particular point). Optimum drainage occurs when the water of the suspension drains through the screen very quickly. Optimum drainage generally occurs when the paper or paper board has a very open structure and so frequently is associated with poor retention and formation.

In order to modify these properties it is standard practice to include water soluble polymeric material and, depending upon the material that is chosen, an appropriate balance of properties is achieved. For most purposes a relatively high molecular weight polymer is included and this has the effect of causing flocculation of the fibres, and any filler, that is present.

If the flocs are very large then although retention and drainage may be good, formation tends to be poor. If the flocs are small then formation is much better, but the other properties may be adversely affected.

It is well known that floc characteristics depend, inter alia, on the molecular weight of the polymeric flocculant, and that in general the size of the floc increases with increasing molecular weight of the flocculant. Since very large flocs would be expected to give very poor formation it is well established in the industry that the molecular weight of the retention aid must not be too high. Typically polymeric retention aids have intrinsic viscosity up to 7 dl/g although some products have intrinsic viscosity up to about 10 dl/g when they are cationic. So far as we are aware, no commercial paper or paper board processes have been operated commercially using cationic retention aids having higher intrinsic viscosity.

Irrespective of the molecular weight, it is well known that the application of shear to the flocculated suspension is generally undesirable since it tends to reduce floc size (which might in theory give some improvement in formation) but at the expense of giving very poor retention. In order to minimise shear, it is therefore conventional to mix the retention aid into the suspension using a minimum of agitation, often after the last point of high shear and in the headbox, and then to flow the suspension from the headbox on to the screen, through which it drains, all without any deliberate application of shear.

A lot of work has been put into studying the effect of shear on the flocs and, in general, it is accepted that it is generally best to form flocs that are relatively small and to avoid further disruption of them.

In EP 0202780 is described how reverse phase dispersion polymers that are slightly cross linked can have beneficial effects on floc size and floc strength but this is not directly relevant to the problem we are now confronting, particularly since the use of slightly insolubilised polymers would generally be severely contra-indicated. A normal standard for polymeric retention aids is that they must be very highly soluble, for fear of leaving insoluble residues on the paper or paper board.

In EP 0235893 is described a particular process in which polymer is added at an early stage in the process, the resultant suspension is then sheared, and bentonite is then added prior to drainage (generally without subsequent shearing). Although this process is very successful it does require the late addition of bentonite. This intermediate shearing of the flocs is an unusual process but the subsequent addition of bentonite then has the effect of converting the sheared flocs into what can be regarded as a very large flocculated structure. Again it is preferred that this final structure should be left substantially undisrupted.

In all processes that do not have this late addition of bentonite, the rule therefore is to avoid any deliberate application of shear and to select the polymer so that it gives relatively tight flocs that will withstand the process conditions to which it is subsequently subjected.

As indicated above, the reality is that the polymeric retention aids that have been used have intrinsic viscosity up to about 10 dl/g when they are cationic (which is normally preferred). There have been some very speculative suggestions in the literature that higher molecular weights might be useful. For instance in U.S. Pat. No. 3,901,857 it is stated that the cationic retention aids should have an intrinsic viscosity of 12 to 25 dl/g. This has not proved to be normal experience and we are unaware of such materials ever having been commercialised. The reason for this may be that the polymers in that were made by polymerisation in dilute aqueous solution and were kept in solution form, which would render the process rather uneconomic as most paper mills require reverse phase dispersions or powdered polymers. In EP 277728-A cationic retention aids are defined in terms of specific viscosity but it is unclear what order of molecular weight they have.

A difficulty with cationic polymeric retention aids is that the solubility of the polymer tends to deteriorate as the molecular weight increases and certainly the polymer technology in 1975 could not have produced a solid grade (reverse phase dispersion or powder) retention aid having intrinsic viscosity of 25 and which had adequate solubility.

Full solubility of the polymer is absolutely essential, since otherwise insoluble particles remain on the paper and this is unacceptable.

Another problem with the speculative possibility of using such high molecular weights is that these polymers would inevitably have given very large flocs and exceedingly bad formation when used on conventional paper-making machines of that period.

The screen of a paper-making machine is travelling as the cellulosic suspension flows, or is forced, on to it. Until recently, the maximum screen speed was up to about 800 meters per minute. The contact of the suspension with this screen causes substantial acceleration to the suspension and this in turn applies shear to the suspension. The cationic retention aids having intrinsic viscosity of up to 7 to 10 dl/g give satisfactory flocs under these conditions.

In recent years however, especially in U.S.A., machines are being operated at even higher screen speeds, typically up to 950 meters per minute or more, and so this increases still further the shear that is applied to the suspension during drainage. Also, because of the very high speed of operation, and therefore the high rate of usage of suspension, it is increasingly necessary to achieve very fast mixing of the components of the suspension that is to be drained. Accordingly there is increasing tendency to apply considerable shear to the mixture of cellulosic suspension, retention aid and any filler prior to drainage, so as to achieve uniformity in the suspension.

Although these high speed, high shear machines do give increased throughput and can give satisfactory formation, retention tends to be less satisfactory with the result that the solids content in the drainage water is undesirably high.

It would therefore be very desirable to be able to provide a process that can permit the application of shear, and in particular that can be operated on the modern very high speed machines, whilst giving good retention and formation properties. Expressed alternatively, it would be desirable, when using a relatively high speed machine, to be able to achieve better retention at equal dosage, or a saving in retention aid for equal retention, than when using conventional systems.

We have surprisingly found that the way to achieve these objectives is to use a retention aid that is of a type different from any commercially known cationic retention aid and which will give very large flocs and to rely upon the shear of the modern high speed screen, or apply other shear, to break these flocs down so as to give good formation.

In the invention, paper or paper board is made by drainage through a screen of an aqueous cellulosic suspension containing a water soluble cationic polymeric retention aid formed from water soluble ethylenically unsaturated monomer or monomer blend, and in this process the polymeric retention aid has intrinsic viscosity of at least about 12 dl/g, the formation of the paper or paper board is improved without substantial deterioration in retention by subjecting the suspension to shear before or during drainage and the polymer is introduced into the suspension as a solution that has been made by dissolving in water a powdered or reverse phase suspension of the polymer that has a solubility, as defined below, of less than 25 lumps per 1 g.

The solubility defined herein is an indication that the polymer is a true solution and will not leave any unwanted polymeric deposits on the paper or paper board.

The test is carried out as follows: 1 g polymer is weighed out into a screw top jar. 5 ml acetone is added to wet out the polymer. 95 ml de-ionised water is added to the jar and the closed jar is shaken on a laboratory shaker for 2 hours to ensure maximum dissolution. A 150 μm stainless steel sieve is wetted out and the polymer solution is poured onto the sieve. The jar is rinsed once with water which is poured through the sieve. The sieve is gently washed with cold running water to remove excess polymer solution until the back of the sieve is no longer slimy. The back of the sieve is dabbed dry with a paper towel and the number of lumps of polymer retained in the sieve is counted. The total number of lumps gives the solubility as defined above, i.e. it is the number of lumps per 1 g dry polymer or of 100 g of a 1% solution of polymer.

The intrinsic viscosity measurements herein are measured by the following technique. The specific viscosity of the test polymer is measured at four different low concentrations (in the range 0.02–0.08% by weight) in 1M buffered sodium chloride solution using a suspended level viscometer at a temperature of 25° C. The value of the reduced viscosity, which is the specific viscosity divided by the polymer concentration, is plotted against the concentration, which at the low concentrations gives a straight line which intercepts the y-axis to give the reduced viscosity at infinite dilution, which is the intrinsic viscosity, reported in units dl/g.

The invention is based in part on the surprising discovery that good formation and good retention are easily obtained upon shearing the very large flocs that are inevitably formed when the retention aid is a very high molecular weight water soluble polymer.

The molecular weight (expressed as intrinsic viscosity) and the degree of shearing that are required for optimum properties are inter-related in that moderately high molecular weight needs to be associated with moderate degrees of shear and very high molecular weight needs to be associated with higher amounts of shear. If the molecular weight is too low having regard to the amount of shear (or if the amount of shear is too high having regard to the molecular weight) retention (and also drainage) will be poor even though formation may be satisfactory. If the molecular weight is too high having regard to the amount of shear (or if the amount of shear is too low having regard to the molecular weight) formation may be satisfactory but retention will be poor. Thus, within these parameters, it is possible to optimise the molecular weight having regard to the amount of shear that is to be applied or, conversely, it is possible to optimise the amount of shear having regard to the molecular weight.

This discovery is contrary to all conventional thinking about retention and formation of paper and paper board. Whereas the prior art required that the molecular weight should be moderate (for instance intrinsic viscosity not more than 9 or 10 dl/g at the most) in the invention much higher molecular weights must be used. Whereas normal commercial practice required that shear should not be applied (unless bentonite is added subsequently) in the invention it is essential to apply shear.

The invention is of particular value when some or all of the shear is caused by the very fast speed of travel of the drainage screen on to which the suspension is applied. Preferably therefore an alternative way of defining the invention is to say that the polymeric retention aid has intrinsic viscosity above about 12 dl/g and the suspension containing the retention aid is applied on to a drainage screen that is moving very fast.

Accordingly the invention provides a solution to the problem of how to achieve good retention and good formation on the very high speed modern paper making machines where the screen travels at above 800 and usually above 850 meters per minute. The speed is generally above 900, most usually above 925, meters per minute. In the invention satisfactory results can be obtained at screen speeds above 950, above 975 and even at 1,000 meters per minute or more, for instance up to 1,050 and 1,100 meters per minute or more. For these speeds the polymer preferably has an intrinsic viscosity in the range 12 to 17, often 13 to 16, dl/g, with best results often being obtained at about IV 14 or 15 dl/g. However if higher screen speeds are required then higher molecular weights may be used, e.g., up to IV of 20 dl/g or more.

The polymer can be added in the headbox with gentle agitation, but, because of the high molecular weight of the polymer, it is now possible to incorporate the polymer under the same mixing conditions as are used for the formation of the thin stock and, in particular, it is no longer necessary to take the usual precautions to avoid shearing the suspension in the headbox or prior to the headbox.

Alternatively, the polymer can be incorporated into the suspension under shear, e.g. at a centriscreen or fan pump, and the suspension then drained on a relatively slow screen.

An essential feature of the invention is that the retention aid should be water soluble. If the retention aid is not water soluble then the retention effect deteriorates and problems may arise due to the appearance of insoluble polymer on or in the paper or paper board. The tendency for insolubility increases as the molecular weight of the retention aid increases (which is another reason why conventional thinking dictates the use of medium to low molecular weight retention aids) due to accidental cross linking, for instance due to impurity amounts of cross linking agent.

It is therefore necessary to ensure that the monomer or monomers used, and the polymerisation conditions used, are such as to keep cross linking to a satisfactorily low level, so that the polymer is substantially linear and is present as a true solution in water before it is mixed with the aqueous cellulosic suspension. Because of the difficulties of insolubility, this may impose an upper limit on the molecular weight that can be satisfactorily obtained from any particular monomer feed. Nevertheless it is possible, by use of appropriately pure monomer, to obtain cationic retention aids having IV values up to, say, 20 dl/g without too much difficulty and, similarly, to obtain anionic or non-ionic retention aids having IV values up to 30 or 40 dl/g without too much difficulty. Higher values than these can be obtained (and used in the invention) if ultra pure monomers are used.

One way of defining the linearity of the polymers is by reference to the ionic regain, as defined in EP 0202780. In the invention the ionic regain should be below 10%, preferably below 5% and most preferably in the region 0 to 2%.

The polymeric retention aid may be made by reverse phase emulsion or dispersion polymerisation to provide a dispersion of aqueous (or dehydrated) polymer particles having a size generally below 10 μm dispersed in non-aqueous liquid, in known manner. Such a dispersion may be converted into polymer solution by mixing it into water, generally in the presence of an oil-in-water emulsifier, in known manner. However the inclusion of the oil can be undesirable and the invention is primarily of value when the polymer is initially supplied as a solid. The solid may have been made by reverse phase bead polymerisation (followed by azeotroping and separating the beads from the non-aqueous liquid) or by gel polymerisation followed by drying and comminution in conventional manner.

Ways of performing the polymerisation so as to minimise the presence of insoluble particles involve careful optimisation of the formation of the reverse phase dispersion of polymer particles, in particular the avoidance of local overheating or other local variations in process conditions within the polymerising mixture. Cationic polymers that have this very good solubility combined with high intrinsic viscosity are new materials when they have been made by gel polymerisation or by reverse phase polymerisation.

The polymer is made from cationic monomers alone or from blends thereof with non-ionic monomers or, if an ampholytic polymer is required, with anionic monomers as well. When a blend of cationic and non-ionic monomers is used, the proportion of non-ionic units may be low, e.g., 5 to 50% by weight but often the polymer is formed from 10 to 50% by weight cationic units and 90 to 50% by weight non-ionic units.

Suitable cationic monomers are dialkylaminoalkyl (meth) acrylates and dialkylaaminoalkyl (meth) acrylamides. The cationic monomers are generally used in the form of their acid addition or, preferably, quaternary ammonium salts.

Any of the non-ionic monomers conventionally incorporated into high molecular weight water soluble polymers can be used, but acrylamide is preferred.

Any anionic monomers may be ethylenically unsaturated carboxylic acids such as methacrylic acid or, preferably, acrylic acid, or ethylenically unsaturated sulphonic acids such as 2-acrylamido methyl propane sulphonic acid. Anionic monomers are generally used in the form of ammonium or alkali metal (generally sodium) salts.

Preferably the retention aids are copolymers of acrylamide with cationic monomer, most preferably a copolymer of 10 to 95% (preferably 50 to 90%) by weight acrylamide with 90 to 5% (preferably 50 to 10%) cationic monomer, most preferably dialkylaminoethyl acrylate quaternary ammonium salt (or the corresponding methacrylate compound) wherein the alkyl groups are generally methyl or ethyl.

Particularly preferred copolymers are formed of about 50 to 80%, often 70 to about 80%, by weight acrylamide and the balance diethylaminoethyl acrylate or methacrylate quaternary ammonium salt. Other preferred copolymers include those wherein the quaternary monomer is 50 to 100% of the monomers and acrylamide is 0 to 50% by weight.

When the polymer is quaternised, any of the normal quaternising groups may be used, generally methyl sulphate or methyl chloride. The intrinsic viscosity of the polymer is preferably around 14 or 15 dl/g or more and the polymer is preferably produced as a powder and is dissolved in water to give a solubility as explained above.

Generally the high molecular weight soluble polymer is the last paper making additive that is added to the suspension and thus normally bentonite or other significant materials are generally not added after it, although bentonite may be added beforehand if desired, for instance as described in EP 17353, or subsequently as in EP 235893.

Other paper making additives may be incorporated in conventional manner and the suspension may either be substantially unfilled, for instance containing not more than about 15%, and generally not more than about 10%, inorganic filler or it may be filled, for instance containing more than 15% inorganic filler (based on the dry weight of the suspension). If the suspension has a high cationic demand it is particularly preferred to treat it first with bentonite and then to use a substantially non-ionic high molecular weight retention aid, for instance as described in EP 17353.

The amount of retention aid that is incorporated in the suspension is conventional, for instance in the range 100 to 1,000 grams dry polymer per tonne dry weight of suspension, often 200 to 500 grams, although higher amounts may be used if desired.

Improved results, especially as regards formation, can also be obtained by adding a low or medium molecular weight polymer before the high molecular weight polymer. Suitable amounts are in the range 50 to 1000 g/tonne. Generally the low or medium molecular weight polymer is cationic, and the other polymer may be slightly anionic, nonionic or, preferably, cationic.

Suitable cationic low to medium molecular weight polymers are formed from the cationic monomers quoted above (often as copolymers with acrylamide), diallyldimethylammonium chloride (often copolymerised with acrylamide), or the polymers may be polyethyleneimines or amine-halohydrin or amine-haloalkane polymers. The molecular weight is typically in the range 10000 to 1 million, for instance IV 0.1 to 1 dl/g or 2 dl/g.

EXAMPLE 1

A medium molecular weight cationic retention aid may be made by conventional gel polymerisation of 75% acrylamide with 25% by weight quaternary salt of diethylaminoethyl acrylate to intrinsic viscosity 7. After drying in conventional manner the product typically has a solubility of less than 10 lumps per 100 grams of 1% aqueous solution of polymer. When the same monomer feed is used under polymerisation conditions that are known to favour higher molecular weights it is possible to obtain intrinsic viscosity of, say, 14 but the solubility is liable to be above 30 lumps per 100 grams. However when the cationic and acrylamide monomers are purified by conventional purification techniques so as to remove substantially all traces of cross linker, a polymer having intrinsic viscosity of about 14 and giving less than 10 lumps per 100 grams can easily be obtained.

When these cationic polymers giving less than 10 lumps per 100 grams are compared on two different paper making machines, their performance depends upon the conditions under which the machine is used. When the polymers are added as retention aid with gentle agitation to the headbox and the screen speed is about 850 meters per minute the IV 7 polymer can give good retention and good formation, whilst the IV 14 polymer is liable to give poor formation. When the screen speed is increased to about 1,000 meters per minute the IV 14 polymer can give good retention and good formation (substantially equivalent to that obtainable with the IV 7 polymer at a screen speed of 850 meters per minute) whilst the IV 7 polymer is liable to give poor retention.

EXAMPLE 2

Two cationic retention aids, A and B, were made by conventional gel polymerisation of 75% acrylamide with 25% by weight quaternary salt of diethylaminoethyl acrylate, A to an intrinsic viscosity of 8 $dlg^{-1}$ and B to an intrinsic viscosity of 13 $dlg^{-1}$. Both polymers had a solubility of less than 10 lumps per 1 g (polymer). They were then compared for performance on a commercial paper machine using a bleached kraft-pulp finish to produce the paper grades. Each retention aid was run for 30 days on the machine and yielded the following comparative data averaged for each 30 day period.

| POLYMER | INTRINSIC VISCOSITY dl/g | POLYMER DOSE g/tonne | FIRST PASS RETENTION % | MACHINE SPEED m/min |
|---|---|---|---|---|
| A | 8.0 | 440 | 75.6 | 805 |
| B | 13.0 | 350 | 75.7 | 859 |

This demonstrates improved machine speed at an equivalent retention level with a reduced retention aid dosage. No disadvantageous effect on sheet formation was observed with the high molecular weight retention aid.

EXAMPLE 3

To demonstrate the effect of shear on the composition at different molecular weights (IV) tests were carried out in the laboratory as follows. Polymers of different IV's in the range 4 to 17 dl/g were prepared by gel polymerisation of 75% acrylamide and 25% of the quaternary salt of diethylaminoethyl acrylate. All polymers had a solubility of less than 10 lumps per 1 g (polymer). Stock solutions of these polymers were made up for addition to the dilute paper stock. Shearing was carried out by placing the stock solution into a Brit jar mixer and running it at 1500 rpm for predetermined periods in the range 15–45 s.

To 250 ml dilute stock of 0.25% consistency was added the desired amount of stock solution to give a polymer dosage of 400 g dry polymer per 1 t stock measured dry, (i.e. fibre plus filler). The stock was inverted five times to ensure thorough mixing and then poured into a Hartley funnel (9.5 cm diameter), fitted with a fast filter paper (Whatman No. 541) which had been previously conditioned and weighed. In the apparatus used the Hartley funnel was attached to a conical flask and vacuum source and a vacuum gauge and stopcock were connected to the vacuum line. The stock was added to the Hartley funnel with the stopcock in the open position and full vacuum applied. Immediately after filling the funnel a stop watch was started and the stopcock closed. The maximum vacuum gauge reading was taken, ($P_1$), and the time taken until the pad just assumed a uniform matt appearance corresponding to removal of excess water. The drainage time was recorded to this point.

Filtration was continued until the vacuum gauge reading had dropped to a constant value as air was drawn through the pad. This vacuum was noted, ($P_2$), then immediately released and the pad and filter paper quickly removed and weighed. The pressure drop $\Delta P$ is $P_1 - P_2$. Each measurement was carried out five times to obtain statistically significant results. The poorer the formation of the formed pad, the larger the vacuum drop, as air is drawn through the pad, and consequently the wetter the pad. A short drainage time is desirable.

The results are as follows:

TABLE

| Polymer IV dl/g | Shear time (sec) | Drainage Time (sec) | $\Delta P$ |
|---|---|---|---|
| — | 0 | 120 | 1.5 |
| 4.0 | 0 | 24 | 9 |
| | 15 | 28 | 7.5 |
| | 30 | 31 | 6.8 |
| | 45 | 33 | 6.4 |
| 6.1 | 0 | 23 | 9 |
| | 15 | 26 | 8.5 |
| | 30 | 30 | 7.7 |

TABLE-continued

| Polymer IV dl/g | Shear time (sec) | Drainage Time (sec) | ΔP |
|---|---|---|---|
| | 60 | 33 | 6.6 |
| 8.2 | 0 | 22 | 9.3 |
| | 15 | 23 | 8.9 |
| | 30 | 27 | 8.0 |
| | 60 | 31 | 6.8 |
| 11.5 | 0 | 23 | 9.5 |
| | 15 | 25 | 8.5 |
| | 30 | 27 | 8.0 |
| | 60 | 32 | 6.6 |
| | 90 | — | — |
| 13.8 | 0 | 22 | 9.5 |
| | 15 | 24 | 8.7 |
| | 30 | 27 | 7.9 |
| | 60 | 31 | 6.6 |
| | 90 | — | — |
| 15.2 | 0 | 23 | 9.5 |
| | 15 | 25 | 8.6 |
| | 30 | 25 | 8.7 |
| | 60 | 30 | 7.2 |
| | 90 | 34 | 6.5 |
| 17.1 | 0 | 19.5 | 9.7 |
| | 15 | 22 | 9.1 |
| | 30 | 25 | 8.7 |
| | 60 | 29 | 7.8 |
| | 90 | 31 | 6.9 |

The results show that increasing shear increases the drainage time for all the polymers but that the higher IV polymers, especially those above IV 15 give the best drainage times, even at high shear, which was not expected. These improved drainage times are shown by the pressure drop values not to be at the expense of worse formation. There is unexpectedly no significant difference between the pressure drop, which we have found to be a good indication of formation, using the higher IV polymers compared to the conventional lower IV polymers.

We claim:

1. In a process or making paper or paper board comprising providing a solution of a water soluble cationic polymeric retention aid formed from 10 to 95% by weight acrylamide and 90 to 5% dialkyl aminoalkyl(meth)acrylate or dialkyl aminoalkyl(meth)acrylamide as acid addition or quaternary ammonium salt, mixing said solution into an aqueous cellulosic suspension to provide an amount of said polymeric retention aid of from 100 to 1,000 grams dry weight polymer per ton dry weight of suspension, and then draining said aqueous cellulosic suspension through a traveling screen and thereby forming paper or paper board, the improvement which comprises making the speed of the traveling screen above 850 meters per minute, providing the said cationic polymeric retention aid as a powder, using as the said cationic polymeric retention aid a linear polymer that has a solubility in water of less than 25 lumps per gram polymer and that has intrinsic viscosity of at least 12 dl/g, providing the said solution by mixing said powder with water and thereby forming a solution that is free of undissolved polymer particles that will leave polymer deposits on the paper or paper board, whereby the retention and formation are maintained relative to the retention and formation obtained when the said polymer is replaced by a larger amount of polymer formed from the same monomer or monomer blend but having intrinsic viscosity in the range 7 to 10 dl/g.

2. A process according to claim 1 in which the solubility is less than 10 lumps per lg..

3. A process according to claim 1 in which the intrinsic viscosity is 13 to 17 dl/g.

4. A process according to claim 3 in which the screen speed is 900 to 1100 meters per minute.

5. A process according to claim 1 in which the linear polymer has an ionic regain of less than 10%.

6. A process according to claim 7 in which the polymer has a solubility of less than 10 lumps per gram; an intrinsic viscosity of 13 to 17 dl/g and an ionic regain of less than 5%.

7. A process according to claim 6 in which the polymer is a polymer of 10 to 50 weight % cationic monomer and 90 to 50% non-ionic monomer and has an ionic regain of 0 to 2% and in which the screen speed is 900 to 1100 meters per minute.

8. A process according to claim 1 in which the screen speed is at least 1,000 meters per minute.

9. A process according to claim 1 in which said solution is fed to the head box of the paper or paper board manufacturing equipment and the head box effluent containing the cationic polymeric retention aid is fed to the screen.

10. In a process of making paper or paper board comprising providing a solution of a water soluble cationic polymeric retention aid formed from a polymerization mixture comprising a water soluble ethylenically unsaturated monomer or monomer blend, mixing said solution into an aqueous cellulosic suspension to provide an amount of said polymeric retention aid of from 100 to 1,000 grams dry weight polymer per ton dry weight of suspension, and then draining said aqueous cellulosic suspension through a traveling screen and thereby forming paper or paper board, the improvement which comprise making the speed of the traveling screen above 850 meters per minute, providing the said cationic polymeric retention aid as a powder, using as the said cationic polymeric retention aid a linear polymer that has a solubility in water of less than 25 lumps per gram polymer and that has intrinsic viscosity of at least 12 dl/g and that has an ionic regain of less than 10% and is formed from 10–95% by weight acrylamide and 90–5% by weight monomer selected from dialkyl aminoalkyl(meth)acrylate and dialkyl aminoalkyl(meth)acrylamide as acid addition or quaternary ammonium salt, providing the said solution by mixing said powder with water and thereby forming a solution that is free of undissolved polymer particles that will leave polymer deposits on the paper or paper board, whereby the retention and formation are maintained relative to the retention and formation obtained when the said polymer is replaced by a larger amount of polymer formed from the same monomer or monomer blend but having intrinsic viscosity in the range 7 to 10 dl/g.

11. A process according to claim 10 in which the polymer has a solubility of less than 10 lumps per gram, an intrinsic viscosity of 13 to 17 dl/g and an ionic regain of less than 5%.

12. A process according to claim 11 in which the polymer is a polymer of 10 to 50 weight % cationic monomer and 90 to 50% non-ionic monomer and has an ionic regain of 0 to 2% and in which the screen speed is 900 to 1100 meters per minute.

* * * * *